US008257894B2

(12) United States Patent
Srinivasan et al.

(10) Patent No.: US 8,257,894 B2
(45) Date of Patent: Sep. 4, 2012

(54) TONER HAVING IMPROVED CHARGE CHARACTERISTICS

(75) Inventors: Kasturi Rangan Srinivasan, Longmont, CO (US); Rick Owen Jones, Berthoud, CO (US)

(73) Assignee: Lexmark International, Inc., Lexington, KY (US)

( * ) Notice: Subject to any disclaimer, the term of this patent is extended or adjusted under 35 U.S.C. 154(b) by 801 days.

(21) Appl. No.: 12/340,042

(22) Filed: Dec. 19, 2008

(65) Prior Publication Data

US 2010/0159378 A1 Jun. 24, 2010

(51) Int. Cl.
*G03G 9/08* (2006.01)

(52) U.S. Cl. ..... 430/108.6; 430/108.7

(58) Field of Classification Search ..... 430/108.6, 430/108.7

See application file for complete search history.

(56) References Cited

U.S. PATENT DOCUMENTS 5,429,647 A * 7/1995 Larmie ..... 51/295

FOREIGN PATENT DOCUMENTS

JP 53081127 A * 7/1978

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 178-182.*

Derwent Abstract of JP 53-081127 (Jul. 1987).*

English language translation of JP 53-081127 (Jul. 1987).*

* cited by examiner

*Primary Examiner* — Christopher Rodee

(57) ABSTRACT

This invention provides a toner with improved charge and charge stability by suitable addition of extra particulate additives (EPA) such as aluminum cerium oxide and/or cerium zirconium oxide. The additives may be combined with toner in a conical mixer having selected temperature control. The invention also provides toner which may provide reduced print quality defects such as ghosting or residual image and fade-to-color.

4 Claims, No Drawings

TONER HAVING IMPROVED CHARGE CHARACTERISTICS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present disclosure relates generally to toners employed as dry particulates to develop electrostatic images and then fused while under pressure and heat.

2. Description of the Related Art

Toners for use in electrophotographic printers may include two primary types, namely chemically prepared toners (CPT) and toners made by a mechanical grinding process. CPT may have significant advantages over toners made by a mechanical grinding process. In a mechanical grinding process, particle breakage may be difficult to control and minimize. Also, the shape of mechanically ground particles may be more irregular than CPT particles. Hence, the particle size distribution of mechanically ground toner particles may be relatively broader than for CPT particles.

There are several types of CPT, depending on the process used to make the CPT. CPT may generally be classified as a suspension toner, an emulsion aggregation toner, a dispersion toner, or a chemically milled toner. Of the foregoing, a suspension toner is made by the simplest process. However, the shape of a suspension toner may be limited to spherical, and the size distribution of such toner may be dependent on how the toner ingredients are dispersed in a monomer used to make the toner. On the other hand, an emulsion aggregation toner may involve a more complex process. However, the emulsion aggregation process may provide a toner having a relatively narrower size distribution, and the shape and structure of the toner particles may be more controllable.

In a typical emulsion aggregation chemically prepared toner process, the toner components may include pigment, wax, and a latex binder which may be dispersed by use of surfactants. The toner may optionally include a charge enhancing additive or charge control agent (CCA).

One of the more important requirements of printers is print quality. In color laser printers, resolution may be very critical. Higher or better resolution may be achieved by using toner having a small particle size. Small particle size may be more difficult to achieve from a conventional toner processing technique, due to limitations in mechanical extruding/grinding. By preparing the toner chemically (CPT), a smaller particle size may be more readily obtained. As noted above, there may be at least two processes to prepare a chemical toner, i.e. a suspension polymerization (SP), or an emulsion agglomeration (EA) process.

Toner may consist of a base particle and surface-borne extra particulate additives (EPA). These extra particulates may serve a variety of functions, may generally be submicron in size, and have a very high surface area. The high surface area of the EPA and morphology of the toner may tend to promote adhesion between the EPA and the toner particles. Thus, toner particles may be treated with smaller size particulate additives such as silicas, titanias, other metal oxides, metal carbides or organic microspheres. The addition of these particulate additives may improve the charge stability, flow characteristics, and environmental stability of toner. Treatment of toner particles with additives may render the toner more stable at various temperature and humidity conditions. As the particulate additives may be physically held on the surface of the toner particle, there may be some additives which may be more difficult to dislodge from the toner particle, thereby affecting such toner properties as filming, charging, mass flow, and, in general, print quality.

SUMMARY OF THE INVENTION

An improvement in the level of charge and the charge stability of a toner in the form of toner particles, may be provided by the addition of extra particulate additives such as aluminum cerium oxide ($AlCeO_3$), and/or cerium zirconium oxide ($CeO_2$).($Zr0_2$) to such toner. The addition of these extra particulate additives may also improve print quality defects such as ghosting or residual image and fade-to-color.

In one exemplary embodiment, an electrophotographic toner composition comprising toner particles and at least one particulate metal oxide dispersed with the toner particles is provided, wherein the metal oxide is selected from the group consisting of aluminum cerium oxide, cerium zirconium oxide and combinations thereof and the metal oxide content is from 0.05 to 1.0 weight percent of the toner composition.

In another exemplary embodiment, an electrophotographic toner composition comprising toner particles and at least one particulate metal oxide dispersed with the toner particles is provided, wherein the metal oxide is selected from the group consisting of aluminum cerium oxide, cerium zirconium oxide and combinations thereof and the metal oxide content is from 0.05 to 1.0 weight percent of the toner composition and further including silica oxide and titania at a combined weight of less than 5% of the weight percent of the toner composition.

In another exemplary embodiment, a method is provided for improving the charge characteristics of toner comprising mixing in a conical mixer a toner composition and a first extra particulate additive to form a mixture, wherein said toner composition comprises polymer material having a glass transition temperature (Tg) and said mixing is carried out wherein said mixture is raised to a temperature that exceeds said Tg. This may be followed by screening said mixture. This then may be followed by adding additional extra particulate additives and mixing wherein the mixture is maintained at a temperature less than Tg, wherein the first extra particulate additive is selected from the group consisting of aluminum cerium oxide, cerium zirconium oxide and combinations thereof, and the first extra particulate additive content is from 0.05 to 1.0 weight percent of the toner composition and wherein the additional extra particle additives comprise silica oxide and titania at a combined weight percent of less than 5% of the toner composition.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure relates to the addition of extra particulate additives to image forming substances such as toner. The image forming substance may be used in, for example, electrophotographic printers, inkjet printers, copiers, faxes, all-in-one devices or multi-functional devices.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The addition of extra particulate additives may be accomplished in one exemplary embodiment by the method disclosed in United States Patent Publication No. 2008/0090167 A1 dated Apr. 17, 2008, entitled "Method Of Addition Of Extra Particulate Additives To Image Forming Material", which is commonly owned by the assignee of the present invention, and is included herein in its entirety.

That method operates to provide a finishing to toner particles, as more specifically described below. Such finishing may rely upon what may be described as a device for mixing, cooling and/or heating the particles which is available from Hosokawa Micron BV and is sold under the trade name "CYCLOMIX." Such device may be understood as a conical device having a cover part and a vertical axis which device narrows in a downward direction. The device may include a rotor attached to a mixing paddle that may also be conical in shape and may include a series of spaced, increasingly wider blades extending to the inside surface of the cone that may serve to agitate the contents as they are rotated. Shear may be generated at the region between the edge of the blades and the device wall. Centrifugal forces may therefore urge product towards the device wall and the shape of the device may then urge an upward movement of product. The cover part may then urge the products toward the center and then downward, thereby providing a feature of recirculation.

The device as a mechanically sealed device may operate without an active air stream, and may therefore define a closed system. Such closed system may therefore provide relatively vigorous mixing and the device may also be configured with a heating/cooling jacket, which allows for the contents to be heated in a controlled manner, and in particular, temperature control at that location between the edge of the blades and the device wall. The device may also include an internal temperature probe so that the actual temperature of the contents can be monitored.

For example, conventional toner or chemically prepared toner (CPT) may be combined with one or more extra particulate additives and placed in the above referenced conical mixing vessel. The temperature of the vessel may then be controlled such that the toner polymer resins are not exposed to a corresponding glass transition temperature or Tg which could lead to some undesirable adhesion between the polymer resins prior to mixing and/or coating with the EPA material. Accordingly, the heating/cooling jacket may be set to a temperature of less than or equal to the Tg of the polymer resins in the toner, and preferably to a cooling temperature of less than or equal to about 25° C.

The conical mixing device with such temperature control may then be operated wherein the rotor of the mixing device may preferably be configured to mix in a multiple stage sequence, wherein each stage may be defined by a selected rotor rpm value (RPM) and time (T). Such multiple stage sequence may be particularly useful in the event that one may desire to provide some initial break-up of toner agglomerates. In addition, such initial first stage of mixing may be controlled in time, such that the conical mixer operates at such rpm values for a period of less than or equal to about 60 seconds, including all values and increments therein. Then, in a second stage of mixing, the rpm value may be set higher than the rpm value of the first stage, e.g., at an rpm value greater than about 500 rpm. Furthermore, the time for mixing in the second stage may be greater than about 60 seconds, and more preferably, about 60-180 seconds, including all values and increments therein. For example, the second stage may therefore include mixing at a value of about 1300-1350 rpm for a period of about 90 seconds.

It can therefore be appreciated that with respect to the mixing that may take place in the present invention, as applied to mixing EPA with toner, such mixing may efficiently take place in multiple stages in a conical mixing device, wherein EPA may be added in a first stage wherein the breaking of aggregates may be accomplished, followed by screening, and then additional EPA added before the toner is cooled. In addition, the temperature of the mixing process may again be controlled within such multiple staged mixing protocol such that the heating/cooling jacket and/or the polymer within the toner (as measured by an internal temperature probe) is maintained below its glass transition temperature (Tg).

It has been found that the mixing of toner particulate with extra particulate additive in the conical mixing device according to the above provides a relatively more uniform surface distribution of EPA.

The extra particulate additives (EPA) may serve a variety of functions, such as to modify or moderate toner charge, increase toner abrasive properties, influence the ability/tendency of the toner to deposit on surfaces, improve toner cohesion, or eliminate moisture-induced tribo-excursions. The extra particulate additives may therefore be understood to be a solid particle of any particular shape. Such particles may be of micron or submicron size and may have a relatively high surface area. The extra particulate additives may be organic or inorganic in nature. For example, the additives may include a mixture of two inorganic materials of different particle size, such as a mixture of differently sized fumed silica. The relatively small sized particles may provide a cohesive ability, e.g. the ability to improve powder flow of the toner. The relatively larger sized particles may provide the ability to reduce relatively high shear contact events during the image forming process, such as undesirable toner deposition (filming).

Chemical toner (Toner 1) was prepared comprised of a styrene-acrylate based copolymer having a molecular weight (Mw) of about 151,000, a number average molecular weight (Mn) of about 8000, and a glass transition temperature (Tg) at about 51° C. The toner further included magenta pigment (PR122 at about 9%), polyethylene wax (at about 4%), and a charge control agent (at about 1.5%). The toner was placed in a CYCLOMIX along with either 1% by weight of either a fumed silica, R812 from Degussa Chemical, or 1% of aluminum cerium oxide ($AlCeO_3$) (ACO from Aldrich Chemical) having a BET surface area of about 50-55 $m^2/g$. The primary particle size for the silica (R812) was about 8-9 nm, in comparison to about 20 nm for the Aluminum Cerium Oxide. The toner and additive were mixed in the CYCLOMIX for about 1 minute at 20-22° C. The treated toner was screened, placed back in the CYCLOMIX and 2% Silica (RX-50 from DeGussa) and 0.5% titania (FTL-110, an acicular titanium oxide from Ishihara Sangyo Kaisha, Ltd.) were added. The CYCLOMIX was operated for about 90 seconds at 20-22° C. Subsequently, the finished toner was evaluated in a cartridge run on a bench robot for a period of 8 hours, and the charge and mass measured.

The following table (Table 1) discloses the effect of charging and charge stability of Toner 1 that was treated with either 1% silica or 1% ACO.

TABLE 1

Charge Behavior of Silica vs. Aluminum Cerium Oxide In A Bench Cartridge Robot

| Toner ID | EPA | DR Mass (m/a) ($mg/cm^2$) | DR Initial Charge q/m (μC/g) | DR Avg. q/m (μC/g) | Max-Min q/m (μC/g) |
|---|---|---|---|---|---|
| 1 | 1% R812 silica | 0.36 | −40 | −48 | 33 |
| 1 | 1% Aluminum Cerium Oxide | 0.47 | −23 | −25 | 9 |

Charge per mass ratio (q/m) may be understood as the charge of the toner per mass of the toner as measured on various devices within the imaging device, such as the photoconductor (PC) or developer roll (DR). For example, the value of PC q/m may be determined wherein an image of unfused powder is created (developed) on the PC drum surface. A vacuum pencil may then be employed to remove this toner from the drum surface. The charge of the toner is then accumulated as it is removed by the use of a Faraday cage pencil wherein the insulated cage accumulates the charge from the charged toner as it is collected therein. The weight before and after vacuuming determines the mass of the toner collected, as explained more fully below. An electrometer is connected to the cage to determine the charge of the toner mass removed. It is therefore desirable that the charge per mass ratio of the toner remains relative stable over the passage of time within an image forming apparatus.

Toner mass per unit area (m/a) may be understood as the mass of the toner per unit area as measured on various devices within the imaging device, such as the photoconductor (PC) or developer roll (DR). Again, as noted above, an image of known area ("a") may be developed on the PC surface. Using the vacuum pencil described above, the mass of the toner removed may be determined and a value of PC m/a may be determined. It is therefore desirable that the toner mass per unit area remains relatively stable over the passage of time within an image forming apparatus.

Note that the toner treated with aluminum cerium oxide (ACO) tended to produce a lower charge on the toner particles than did the silica. It should also be noted that the use of ACO produced an average charge much closer to the initial charge and a much smaller range (Max-Min for the duration of the test) than the silica. In other words, the charge stability for the ACO treated toner was better than for the silica treated toner.

Table 2 discloses the performance of Toner 1 having different surface treatments applied in a Lexmark C522 printer

TABLE 2

Performance of Toner 1

| Toner ID | Pages | Toner Usage (mg/pg) | DR Mass (m/a) (mg/$cm^2$) | Printed Page Mass ($mg/cm^2$) | DR Charge q/m (μC/g) | Fade to Color | Ghosting |
|---|---|---|---|---|---|---|---|
| Toner 1 | 5000 | 8.5 | 0.39 | 0.44 | −57.9 | −1.38 | 1.2 |
| Toner 1A | 5000 | 6.9 | 0.39 | 0.42 | −57.7 | −1.18 | 1.0 |
| Toner 1B | 3000 | 27.2 | 0.49 | 0.50 | −34.1 | 1.24 | −0.1 |

*Toner 1 is reference to Toner 1, above, having 1% R812 silica, 2% RX-50 and 0.5% FTL-110.

Toner 1A was Toner 1 with 0.5% strontium titanate in place of 0.5% FTL-110

Toner 1B was Toner 1with 1% ACO in place of R812 and 2% RX-50 and 0.5% strontium titanate.

Note that there was relatively high toner usage for the 1% ACO even at the relatively lower charge level. Ghosting and Fade to Color values were improved by the use of ACO. This then prompted the evaluation of the ACO at lower concentrations.

Fade to Color may be determined by comparing L* and b* values of a solid printed page between a first revolution of the developer roll and a second revolution, using a spectrophotometer. Values close to 0 are preferred, with positive values indicating darker and negative values indicating lightness. L* and b* are two of the three basic coordinates in color space. L* represents the lightness of the color (L*=0 yields black and L*=100 indicates white), and b* represents a position between yellow and blue (b*, negative values indicate blue and positive values indicate yellow).

Ghosting may be determined by evaluating a printed page having a series of alternating vertical solid bars and spaces adjacent an area of solid and half-tone for carryover of the bars into the solid or half-tone areas, the pages printed from a first revolution of the developer roll and a second revolution. A numerical value may be assigned for the difference in the length of the bars for the first revolution compared to the second.

Chemical toner (Toner 2) was prepared comprising a styrene-acrylate based copolymer having a molecular weight (Mw) of about 96,000, a number average molecular weight (Mn) of about 7500, and a glass transition temperature (Tg) at about 48° C. The toner further included cyan pigment (PB 15:3 at about 4%), polyethylene wax (at about 4%), and a charge control agent (at about 1.5%). The toner placed in a CYCLOMIX along with either 0.5% or 1% by weight of either a fumed silica, R812 from Degussa Chemical, or 0.5% or 1% of aluminum cerium oxide ($AlCeO_3$) (ACO from Aldrich Chemical) having a BET surface area of about 50-55 $m^2/g$. The toner and additive were mixed in the CYCLOMIX for about 1 minute at 20-22° C. The treated toner was screened, placed back in the CYCLOMIX and 2% Silica (RX-50 from DeGussa) and 0.5% titania (FTL-110, an acicular titanium oxide from Ishihara Sangyo Kaisha, Ltd.) were added. The CYCLOMIX was operated for about 90 seconds at 20-22° C. Subsequently, the finished toner was evaluated in a cartridge run on a bench robot for a period of 8 hours, and the charge and mass measured.

TABLE 3

Charge Behavior of Lower Concentrations of Silica vs. Aluminum Cerium Oxide In A Bench Cartridge Robot Test

| Toner ID | EPA | DR Mass (m/a) (mg/cm$^2$) | DR Initial q/m (μC/g) | DR Avg. q/m (μC/g) | Max-Min q/m (μC/g) |
|---|---|---|---|---|---|
| Toner 2 | 0.5% R812 | 0.36 | −66 | −35 | 34 |
| Toner 2 | 1% R812 | 0.36 | −44 | −31 | 27 |
| Toner 2 | 0.5% ACO | 0.39 | −26 | −17 | 17 |
| Toner 2 | 1% ACO | 0.46 | −30 | −16 | 16 |

The initial charge of the toner treated with ACO was relatively lower than for silica and the average charge during the test was closer to the initial values for ACO in when compared to that of the silica. Once again, the Max-Min was relatively lower over the course of the test, indicating improved charge stability.

A third evaluation was made using ACO in place of the titania to see whether similar improvements in charge properties might be obtained. FTL-110 is an acicular titania that has been shown to help mitigate starvation. It is believed that the titania helps to improve the charging properties, and hence the mass delivered may be relatively constant. In this evaluation, Toner 2, described above, was treated with 0.5% R812 silica, followed by 2% RX50 silica, and either 0.5% of the FTL-110 titania or 0.5% ACO. Following blending and cooling the finished toner was evaluated in a cartridge run on a bench robot for a period of 8 hours, and the charge and mass measured.

TABLE 4

Charge Behavior of Lower Concentrations of Titania vs. Aluminum Cerium Oxide In A Bench Cartridge Robot Test

| Toner ID | FTL-110 | ACO | DR Mass (m/a) mg/cm$^2$ | DR Initial q/m μC/g | DR Avg. q/m μC/g | Max-Min q/m μC/g | Epping qT | Cohesion (2 g) % |
|---|---|---|---|---|---|---|---|---|
| Toner 2 | 0 | 0 | 0.46 | −59 | −35 | 32 | −40.2 | 3.3 |
| Toner 2 | 0.1% | 0 | 0.49 | −54 | −35 | 33 | −41.5 | 2.4 |
| Toner 2 | 0 | 0.1% | 0.48 | −45 | −32 | 24 | −39.8 | 3.5 |
| Toner 2 | 0 | 0.3% | 0.39 | −47 | −33 | 23 | −36.3 | 5.0 |
| Toner 2 | 0.5% | 0 | 0.40 | −50 | −40 | 25 | −40.8 | 3.0 |
| Toner 2 | 0 g | 0.5% | 0.37 | −41 | −33 | 15 | −33.3 | 3.3 |

As may be seen in Table 4, the addition of titania or ACO does not increase the charge of the toner. In a manner similar to silica, ACO tends to exhibit a lower charge with respect to titania. The charge properties again show a smaller change (Max-Min) through a cartridge life (bench-robot) for ACO in comparison to FTL-110, at various concentrations. Epping charge was measured using a Pes Laboratorium Q/M Meter, also shows a similar trend, wherein, at concentrations of about 0.5% FTL-110 or 0.5% ACO, the ACO tends to provide a lower charge.

The Epping toner charge value ("Epping qT.") reported in Table 4 may be determined by combing toner and carrier beads of approximately 100 micron diameter, which tribocharge with one another. Accordingly, a known amount of toner and carrier beads may be mixed and shaken together, and a pre-weighed sample of such toneribead combination placed in a Faraday cage with screens on both ends. The Epping Q/M meter consists of this cage and directs air in one end of the cage. Charged toner passes with the air stream out of the other end of the cage (i.e., the screen retains the beads). Weights before and after toner removal may provide toner mass; an electrometer may measure the toner charge (i.e., carrier charge of equal and opposite sign corresponding to the toner removed.) It should therefore be appreciated that toner charge may serve as a basis for evaluating toner conveyance in an electrophotographic system. Too low a charge represents toner which may be considered uncontrollable, and one which will not be responsive. Charges which are too excessive may cause problems as such toners may adhere relatively strongly to numerous surfaces and are therefore not amenable to development, transfer, etc., and tend to promote filming events.

Cohesion of the toners, as referenced in Table 4, appears to be relatively unaffected by the addition of titania or ACO, as an extra particulate additive. The off-line characteristic of cohesion may be measured through the use of a Hosakowa Micron powder flow tester. A quantity of toner may be placed in the device which consists of a nested stack of screens resting on a stage which may then be vibrated. Upon shaking/vibrating the stage for a period of time, the amount of toner passing through the screens may be measured to assign a cohesion value. It has been demonstrated that cohesion may then provide useful information regarding toner performance in a printer. For example, relatively low cohesion toner (<2.0) may be difficult to contain and may leak out of bearing and seals. Relatively high cohesion toner (>11) tends not to respond well to mixing and paddles in the toner reservoir within a given cartridge. In addition, such toner may tend to form relatively dense clumps which may then interfere with efficient delivery of toner to a developer roller. Accordingly, it can be seen that the toner formulations herein, which rely upon the use of a conical mixer to mix toner and EPA, may provide acceptable values of cohesion.

It was further found that cerium zirconium oxide (CZO) provided similar performance. CZO or $(CeO_2).(Zr0_2)$ is available from Aldrich Chemical and may have a particle size >50 nm. Again Toner 2, described above, was treated with either 0.2% or 0.5% of an EPA of silica, ACO or CZO, followed by finishing with 2% RX50 silica and 0.5% each of FTL-110 titania and strontium titanate. All toners were evaluated in a Lexmark C522 printer (30 ppm, 7500 pages). Results are summarized in the Table 5.

TABLE 5

Evaluation of Toner Treated with ACO vs. CZO in a Lexmark C522 Printer

| Toner ID | EPA | Toner Usage (mg/pg) | DR Mass (m/a) ($mg/cm^2$) | Printed Page Mass ($mg/cm^2$) | DR Charge q/m (μC/g) |
|---|---|---|---|---|---|
| Toner 2 | 0.2% R812 silica | 6.6 | 0.32 | 0.41 | −66.4 |
| Toner 2 | 0.2% ACO | 11.4 | 0.34 | 0.45 | −48.5 |
| Toner 2 | 0.2% CZO | 10.4 | 0.37 | 0.42 | −56.2 |
| Toner 2 | 0.5% CZO | 19.1 | 0.41 | 0.45 | −47.3 |

Higher levels of CZO increased toner usage. Both ACO and CZO provide a lower charge on the finished toner.

Thus, it is believed, considering the various examples cited above that the addition of cerium compounds such as Aluminum Cerium Oxide, or Cerium Zirconium Oxide to toner may lower the charge and improve the charge stability of such toner. This may also result in improved print performance as Fade to Color and Ghosting may also be improved.

The Aluminum Cerium Oxide and Cerium Zirconium Oxide additives may be used at a concentration of about 0.05% to about 1%, preferably at a concentration of about 0.05% to about 0.5%, and more preferably at concentration of about 0.05% to about 0.25%. In addition, such additives when combined with toner may then be positioned within a toner cartridge as well as positioned within a printing device.

It is contemplated that the use of aluminum cerium oxide, cerium zirconium oxide and combinations thereof may be used to improve the charge and charge stability of toner particles used in electrophotographic devices, the toners prepared by mechanical grinding as well as chemically prepared toners.

The foregoing description is provided to illustrate and explain the present invention. However, the description hereinabove should not be considered to limit the scope of the invention set forth in the claims appended hereto.

What is claimed is:

1. An electrophotographic toner composition comprising:

toner particles;

at least one particulate metal oxide dispersed with the toner particles, wherein the metal oxide is selected from the group consisting of aluminum cerium oxide having the formula $AlCeO_3$, cerium zirconium oxide having the formula $(CeO_2).(ZrO_2)$ and combinations thereof, and the metal oxide content is from 0.05 to 1.0 weight percent of the toner composition; and silica oxide and titania are each present at a combined weight of less than 5% of the weight percent of the toner composition, wherein the titania include an acicular titanium oxide and strontium titanate.

2. The toner composition of claim 1 wherein said metal oxide content is from 0.05 to 0.5 weight percent of the toner composition.

3. The toner composition of claim 1 wherein said metal oxide content is from 0.05 to 0.25 weight percent of the toner composition.

4. The toner composition of claim 1 wherein the particle size for the metal oxides is >50 nm.

* * * * *